United States Patent [19]

Eckholt

[11] 4,030,683

[45] June 21, 1977

[54] THREAD BRAKE FOR DOUBLE THREAD TWISTER

[75] Inventor: Heinrich Eckholt, Muenster, Germany

[73] Assignee: Hamel GmbH Zwirnmaschinen, Muenster, Germany

[22] Filed: Sept. 22, 1976

[21] Appl. No.: 725,494

[30] Foreign Application Priority Data

Sept. 26, 1975 Germany ..... 2543018

[52] U.S. Cl. ..... 242/149; 57/58.86

[51] Int. Cl.[2] ..... D01H 13/10; B65H 59/06; B65H 59/22

[58] Field of Search ..... 57/58.83, 58.86, 106, 57/58.7, 58.49; 242/149, 147 R, 152.1

[56] References Cited

UNITED STATES PATENTS

| | | | |
|---|---|---|---|
| 3,309,858 | 3/1967 | Franzen | 57/58.86 |
| 3,323,299 | 6/1967 | Heimes | 57/58.83 |
| 3,352,510 | 11/1967 | Franzen | 242/149 |
| 3,410,071 | 11/1968 | Heimes | 57/58.49 |
| 3,490,221 | 1/1970 | Heimes et al. | 57/58.86 |
| 3,742,693 | 7/1973 | Greive et al. | 57/58.86 |
| 3,783,597 | 1/1974 | Greive et al. | 242/149 X |
| 3,945,184 | 3/1976 | Franzen | 57/58.86 |

*Primary Examiner*—John Petrakes
*Attorney, Agent, or Firm*—Karl F. Ross; Herbert Dubno

[57] ABSTRACT

A thread brake for a double-thread twister comprises a housing defining a relatively narrow thread passage and having a relatively wide compartment defined by at least one of the housing walls. A braking element provided in the compartment normally lies in a braking portion against the wall at the passage and is displaceable laterally of the passage into a position clear of this passage. Thus a thread extending along the passage is normally pinched by the braking element against the wall. A threading element is also provided in the housing and has an elongated relatively narrow open course. This threading element is displaceable between a position with the course out of alignment with the thread passage in the compartment and into a threading position with the course aligned with the passage in the compartment. Operating means connected to an inlet tube forming part of the passage is displaceable for shifting the threading element from outside the housing into the threading position and for simultaneously displacing the braking element out of the braking position. Two such braking arrangements can be provided in the housing.

22 Claims, 11 Drawing Figures

THREAD BRAKE FOR DOUBLE THREAD TWISTER

CROSS-REFERENCE TO RELATED APPLICATIONS

This application is related to the copending and commonly assigned patent applications Ser. Nos. 724,460; 724,461; and 724,462, all filed Sept. 17, 1976.

FIELD OF THE INVENTION

The present invention relates to a thread brake and, more particularly, to a thread brake for a double-thread twister.

BACKGROUND OF THE INVENTION

In a double-thread twister a pair of yarn packages are normally stacked on a twister spindle and a thread, yarn or filament is pulled off from each of these packages, up around the two yarn packages, and passed down through the hollow spindle. There is normally provided in this spindle a so-called thread brake which pinches the two yarns and tensions them to the extent necessary for proper twisting (see German Offenlegungsschrift DT-OS No. 23 09578).

Such a thread brake normally has a housing with a vertically elongated relatively narrow passage. The housing is formed along this passage with a relatively wide compartment in which is provided a braking element. This element may be a spring-loaded capsule, a ball, or any other similar arrangement which presses a thread or threads passing along the passage against a wall of the compartment so as to tension them as described above.

In order to thread such an arrangement, that is in order to pass the filaments being twisted down through the thread brake, it is necessary to displace the braking element into a position clear of the thread passage. This can be done by providing external means, such as an electromagnet or a permanent magnet which pulls the braking element to the side. It is then possible to pass the filament or filaments down through the thread brake. This threading operation is normally carried out by means of a pneumatic threader which is fitted to the top of the twisting spindle and blows the filaments down through the thread passage once the braking elements has been displaced out of the way.

Such an arrangement has the considerable disadvantage that the relatively wide compartment midway down that thread passage often creates turbulence in the pulse of air that carries the filaments along this thread passage so that the filaments become caught in this compartment. Thus as these filaments are carried downwardly along the thread passage the stream of air carrying them slows suddenly in the braking compartment and the filaments can then catch on the braking mechanism therein. For this reason it is frequently necessary to make several attempts to shoot the filaments down along the thread passage, as rarely can the filament be displaced past the braking compartment on the first try. Such a disadvantage therefore slows the twisting operation and has a correspondingly poor effect on plant efficiency.

OBJECTS OF THE INVENTION

It is therefore an object of the present invention to provide an improved thread brake.

Another object is to provide a thread brake which can be pneumatically threaded without the above-given difficulties.

A further object is to provide a thread brake which is relatively simple to use, and yet at the same time can readily be adjusted for different tensions in the threads passing through it.

SUMMARY OF THE INVENTION

These objects are attained according to the present invention in a thread brake comprising a housing defining a relatively narrow thread passage and relatively wide compartment along this passage which has a wall at the passage.

A braking element is provided in this compartment which normally lies in a braking position against the wall at the passage, and which is displaceable laterally of the passage from the braking position into a position clear of the passage. Thus a thread passing through the passage is normally pinched by the braking element against the wall.

A threading element is also provided in the housing and has an elongated relatively narrow open course. This threading element is displaceable between a position clear of the passage and a threading position with its open course aligned with the passage.

Means is provided for displacing the threading element from outside the housing into the threading position and for simultaneously displacing the braking element out of the braking position.

Thus it is possible to align this relatively narrow open course of the threading element with the thread passage so that the wide compartment does not create the above-mentioned turbulence and a filament or filaments can readily be pneumatically blown down through the thread passage.

In accordance with a feature of this invention the threading element is a longitudinally relatively incompressible bridge and is formed with a longitudinally extending laterally open slot constituting the open course. The braking element is spring loaded and longitudinally compressible. The housing is formed with a pair of walls each of which is concave and open toward the other wall, with both the braking element and the threading element being received between these walls. The operating means is connected to one of these walls and serves to displace it toward the other wall. Such displacement compresses the braking element, which is normally substantially longer than the threading element and, once the two walls are close enough together so that they can engage the opposite ends of the longitudinally incompressible threading element, this element moves into the center of the braking compartment and simultaneously laterally displaces the braking element out of the way. In this position the braking element lies substantially against the slot in the threading element and closes it so that this relatively narrow slot merely acts as a continuation of the relatively narrow passage through the thread brake.

According to a further feature of this invention the one wall is normally biased by means of a spring away from the other wall. Thus when the one wall is released it returns to its original position and the spring-loaded braking element may return to a central position wherein it can pinch a thread against the walls of the compartment. To this end the threading element is provided with means normally displacing it away from the center of the compartment. This last-mentioned means may comprise a magnet provided on the threading element. The housing is formed of iron or steel so that, when released, the threading element clings magnetically to the side of the housing out of the way of the braking element, where it cannot interfere with the thread passing longitudinally down through the housing.

It is noted in this respect that though the thread brake according to the present invention is intended to be used in an upright position with the thread or threads passing longitudinally through it from the top to the bottom, it is also possible to use it in a horizontal position or even pass the thread through it from the bottom to the top. Thus herein the use of the terms "upper"and "lower"or similar terminology is merely meant to be relative and the invention is not intended to be limited to a particular orientation of the thread brake.

In accordance with still another feature of this invention the operating means includes a tube fixed to the one wall and forming a portion of the passage. This tube extends upwardly out of the housing and can be depressed downwardly in order to push the one upper wall downwardly toward the other wall and thereby displace the braking element out of the way and bridge into the path in the compartment as described below. This can normally be done simply by fitting the standard pneumatic threader to the top of the thread brake and pressing it downwardly, the weight of the threader itself normally serving to provide sufficient force for displacement of the braking element out of the way and of the threading element into the passage.

According to yet a further feature of the invention the apparatus is provided with adjustment means that determines the rest position for the one wall against which the braking element bears. Since the brake element is spring loaded the relative positions of the two walls between which it is braced, that is the distance between them, determines the amount of force with which this element will bear on the one wall.

According to this aspect of the invention the housing is provided with a ring serving as an abuttment against which the one wall bears. This ring is axially displaceable but nonrotationable in the housing. Another ring is rotatable but axially nondisplaceable in the housing and is threaded into the one ring. Thus relative rotation of these two rings will axially displace the ring against which the one wall bears so as to change its rest position.

In accordance with still another feature of this invention a spring-loaded latching arrangement is provided having a spring pressing a ball into a multiplicity of depressions in one of the rings and carried in the other ring so as to define a multiplicity of stable positions for these two elements relative to each other. Such an arrangement ensures that, once set, vibration or the like will not cause the arrangement to go out of adjustment.

It is frequently necessary to apply considerable braking force to the filaments passing through the thread brake. Such heavy tensioning freqently causes the thread to snap, as the filaments do not have sufficient strength to bear the considerable force exerted at one location on them. Thus in accordance with the present invention a second such braking element and a second such threading element are provided in a second compartment in the housing. The operating means is connected to both of these arrangements so as to move both of the braking elements out of the way and threading elements into the passage for threading the device.

The second brake element and threading element can be identical to the element described above, that is with a telescoping and longitudinally compressible braking element and a relatively incompressible threading element. To this end the one wall of the second compartment is linked to the other wall of the first compartment. The spring within the first braking element is slightly stiffer than the spring of the second braking element so that when the one wall of the first compartment is depressed downwardly it will first compress the second braking element until the second threading element is aligned in the upper compartment with the passage, then the force will be transmitted through the longitudinally incompressible second threading element and the link to the one wall of the first compartment where the same sequence of movements will take place, that is the braking element will be cammed to the side by the first threading element.

It is possible in such an arrangement to provide adjusting means which shortens the overall length between the uppermost wall and the lowermost wall, that is between the one wall of the first or upper compartment and the other wall of the second or lower compartment. This adjustment means may be constituted as described above, with the one ring formed by an upper housing part containing the first compartment and at the other ring being axially displaceable in a lower housing part but nonrotatable relative thereto.

In accordance with another feature of this invention the braking element may be a ball and the wall of the compartment may be an upwardly concave or frustoconical wall formed with a central opening constituting the thread passage. In this case the threading element is a tube upwardly displaceable along the passage so as to be able to displace the ball from a position overlying the passage at the wall. Thus the adjustment means includes means for either pushing this tube upwardly so as laterally to displace the ball or for displacing the wall downwardly over the tube. In the latter arrangement a downwardly cup-shaped element connected to an inlet tube also forming part of the passage may serve to depress the wall downwardly over the axially or longitudinally nondisplaceable tube so that this tube can move up and laterally deflect the ball. In order to prevent the ball from becoming seated in the top of the tube, the upper end or mouth of this tube is oblique to the passage in such a manner that the ball will fall laterally off the tube as it moves upwardly.

It is possible to combine this arrangement with another such ball-type thread brake as described above or with a plurality of such thread brakes. It is also possible to combine such a ball-type arrangement with a telescoping cartridge-type thread brake as also described above or a plurality of these thread brakes with each other. In all such cases it is necessary to provide links between the respective mechanisms in order to ensure that all of the braking elements are displaced laterally out of the way and the threading elements are displaced into the passage for proper threading. Thus it is possible to obtain a very gentle but firm tensioning of the filaments.

The thread brake according to the present invention is extremely simple to use and yet is of such simple construction that it has an extremely long service life. Its action is sure and it is easily adjustable so that the reloading time for a conventional double-thread twister can be considerably reduced.

BRIEF DESCRIPTION OF THE DRAWING

The above and other objects, features and advantages of the invention will become more readily apparent from the following description, reference being made to the accompanying drawing in which.

SPECIFIC DESCRIPTION

Figure 1:
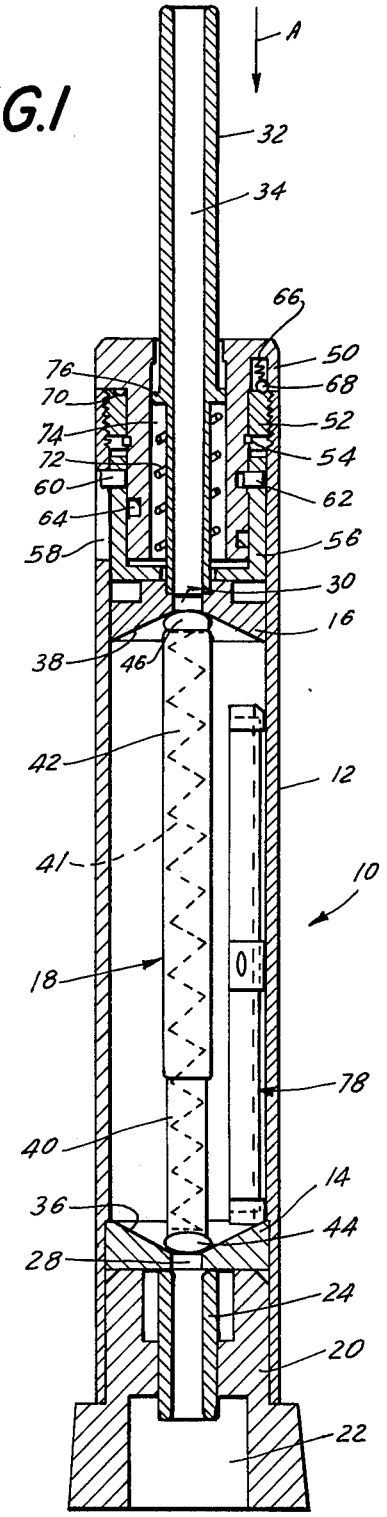
FIGS. 1 and 2 are longitudinal sections through a thread brake in accordance with this invention in the position for use and the position for threading, respectively.
Figure 2:
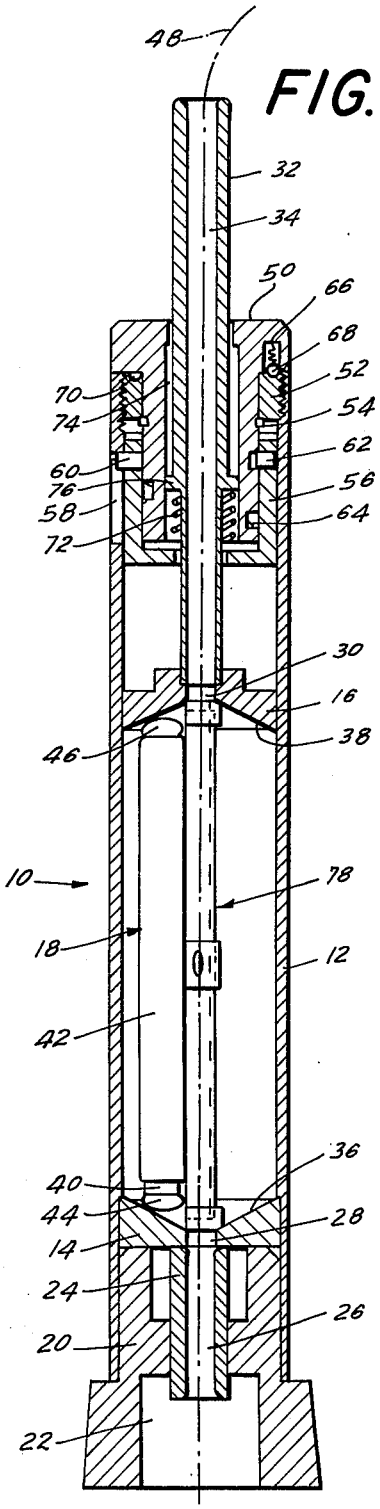
Figure 3:
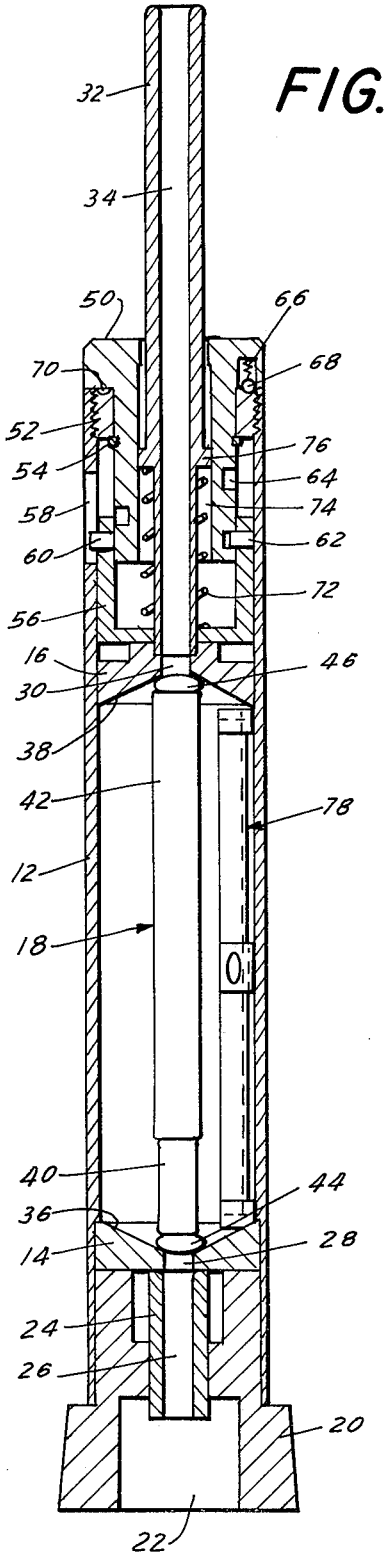
FIG. 3 is a view corresponding to FIG. 1 but showing the arrangement adjusted for maximum filament tension.

The arrangement shown in FIGS. 1 –3 has a ferromagnetic cylindrical steel housing 12 arranged upright so as to define a vertical axis. Defining a braking compartment within this housing 12 are a pair of wall or ring members 14 and 16 between which is pinched a telescoping braking capsule 18. The tubular housing 12 is fixed at its lower end on a connector piece 20 formed with a downwardly open cylindrical recess 22 adapted to fit over a roller bearing at the top of the twister spindle of a double-filament twister. A sleeve or tube 24 having a central axially aligned bore 26 is press-fitted into this member 20 with the bore 26 aligned with a passage-defining hole 28 in the lower seat member 14. The upper seat member 16 similarly has a central passage-defining hole or bore 30 that is aligned with the central hole or passage 34 through a vertically displaceable inlet tube 32. The bores 26, 28, 30 and 34 therefore define the thread passage. The lower seat member 14 is formed with an outwardly flared upwardly concave frustoconical seat 36 and the member 16 is formed with a similar such downwardly flared frustoconical seat 38.

The telescoping braking element 18 is formed of an inner sleeve 40 and an outer sleeve 42 normally pushed apart by a compression spring 41 within the element 18. The inner sleeve 40 has a rounded end 44 that rides continuously on the surface 36 and normally blocks the hole 28 and the other sleeve 42 has a rounded end 46 that rides on the surface 38 and normally blocks the hole 30. Thus a thread shown at 48 in FIG. 2 is pinched by these heads 44 and 46 against the surfaces 36 and 38, respectively, and tensioned with a force determined mainly by the amount of compression of the spring 41.

Figure 11:
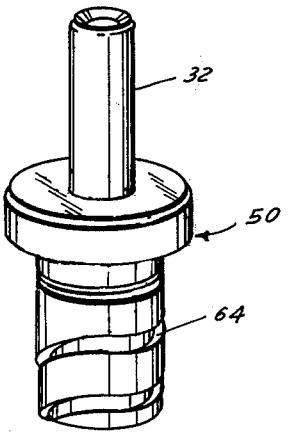
FIG. 11 is a perspective view of the adjustment element and inlet tube of the arrangement of FIGS. 1–3.

Rotatable but axially nondisplaceable on the upper end of the cylindrically tubular housing 12 is an adjustment member 50 which rides on a ring 52 threaded into the upper end of the housing 12. A snap ring 54 on this member 50 allows it to rotate relative to the nonrotatable ring 52 but prevents it from moving axially relative thereto. An adjustment sleeve or ring 56 is provided with an outwardly extending pin 60 engaging through a slot 58 in the side of the housing 12 so that this ring 56, unlike the member 50, can move axially relative to the housing 12 but cannot rotate relative thereto. As best shown in FIG. 11 the element 50 has a helical thread or groove 64 in which engages a radially inwardly extending pin 62 press-fitted into the adjustment ring 56. FIG. 11 also shows how the element 50 is provided on its outer edge with a scale that can be read relative to indicia (not shown) on the housing 12.

Furthermore the member 50 has an axially opening hole in which is provided a spring 66 and a ball 68. The ball can engage in any of an annular array of holes 70 formed in the upper surface of the ring 52 so as to lock the elements or rings 50 and 56 relative to each other in any of a multiplicity of angularly offset positions. Thus once the elements 50 and 56 are set relative to each other vibrations will not change this setting, a forceable turning of the member 50 relative to the housing 12 being necessary to reset the device.

A spring 72 is received within a hole 74 in the member 50 in which the tube 32 is axially displaceable. This spring 72 bears on one side on a flange 76 formed on the tube 32 and at its other end on the member 56. The ring 16 is fixed to the lower end of the tube 32 so that the compression spring 72 normally holds the ring 16 up against the bottom surface of the element 56. Thus this element 56 defines the rest position for this member 16 and, therefore, establishes the extent of compression of the spring 41 and the force with which the ends 44 and 46 will bear on the surfaces 36 and 38, respectively.

Figure 10:
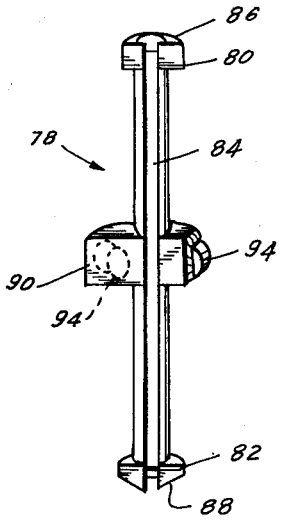
FIG. 10 is a perspective view partly broken away illustrating the threading element of the embodiments of FIGS. 1–6.

A bridge or threading element 78 shown in more detail in FIG. 10 is provided within the compartment defined by the housing 12 and members 14 and 16. This element 78 is elongated and longitudinally incompressible. It has a pair of ends 80 and 82 formed with rounded end surfaces 86 and 88, respectively. In addition, the element 78 is formed with a longitudinally dimensions as the passage formed by the bores 26, 28, 30 and 34. A semicircular-shaped aluminum body 90 is fitted to the element surface 92 of the same radius of curvature as the inside of the housing 12. Imbedded in this aluminum body 90 is a pair of permanent magnets 94 that are capable of holding the member 78 on the inner wall of the housing 12.

In use the apparatus assumes the position shown in FIGS. 1 and 3. The threads 48 pass through the device and are pinched between the heads 44 and 46 and the surfaces 36 and 38. Such pinching tensions the threads with a force dependent upon the extent of compression of the spring 41 between the sleeves 40 and 42 of the telescoping capsule braking element 18. It is possible to increase this force by rotating the adjustment member 50 so that, as shown in FIG. 3, the capsule 18 is longitudinally compressed so as to be almost as short as the bridge member 78. In use the bridge member 78 is secured by magnetic force to the inner wall of the housing 12 and has no effect on the braking of the apparatus.

In order to thread the filaments 48 through the device the tube 32 is passed downwardly in the direction of arrow A of FIG. 1 into the position shown in FIG. 2. Such downward depression of the tube 32 compresses the spring 72 and presses the upper wall member 16 down toward the lower wall member 14. Since the element 18 can be compressed substantially more than the element 78 the end surfaces 86 and 88 of the element 78 will eventually come into contact with the surfaces 38 and 36, respectively. This member 78 is, however, longitudinally incompressible so that once it is engaged by these surfaces 36 and 38 it will be forced inwardly into line with the bores 26, 28, 30 and 34, that is its slot 84 will form a continuous narrow-diameter passage therewith.. At the same time the side of the element 18 will lie against the slot 84 so as substantially to close it from top to bottom. In this position it is therefore possible very easily to blow a pair of filaments 48 through the device, as the passage therethrough is of substantially uniform cross-sectional area.

Once the threading operation is completed the operator need merely release the force exerted downwardly in the direction of arrow A on the tube 32. This will allow the spring 72 to push the tube 32 and, with it, the upper wall 16 upwardly. The braking capsule 18 will automatically extend and push the inextensible threading element 78 to the side so that, once again, its magnets 94 will cling ot the side of the housing 12. The braking element 18 again assumes the position of FIG. 1 or of FIG. 3.

At any time, even during operation of the machine, it is possible to rotate the adjustment member 50 and change the setting of the braking element.

Figure 4:
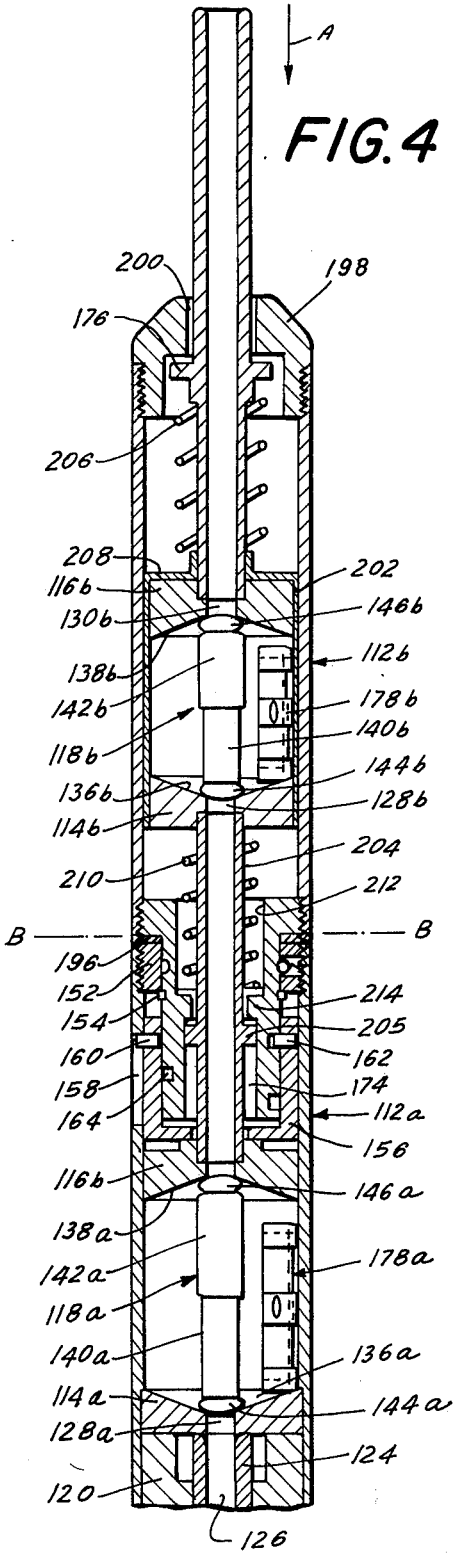
FIGS. 4, 5 and 6 are views similar to FIGS. 1, 2 and 3 respectively, illustrating another thread brake according to this invention.
Figure 5:
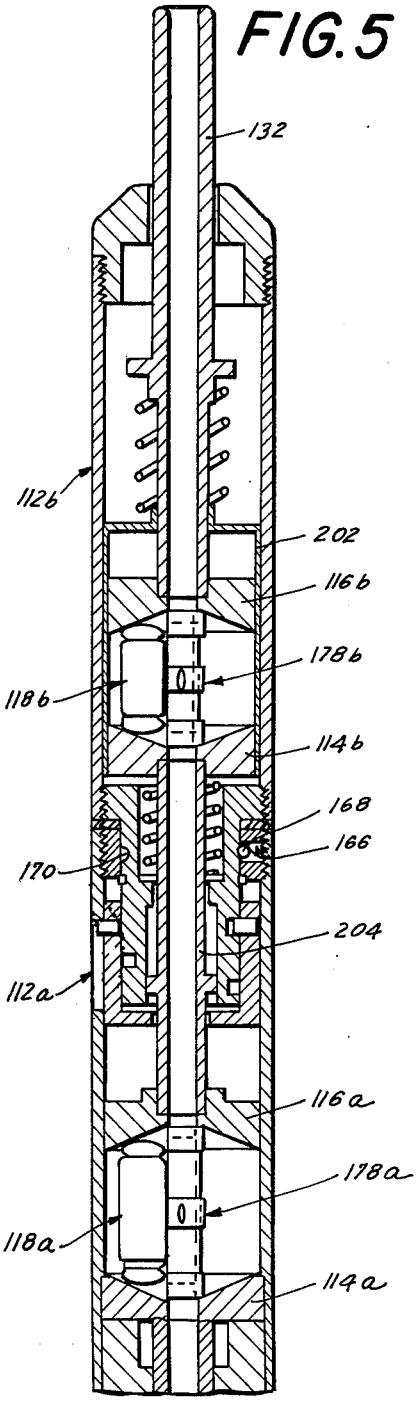
Figure 6:
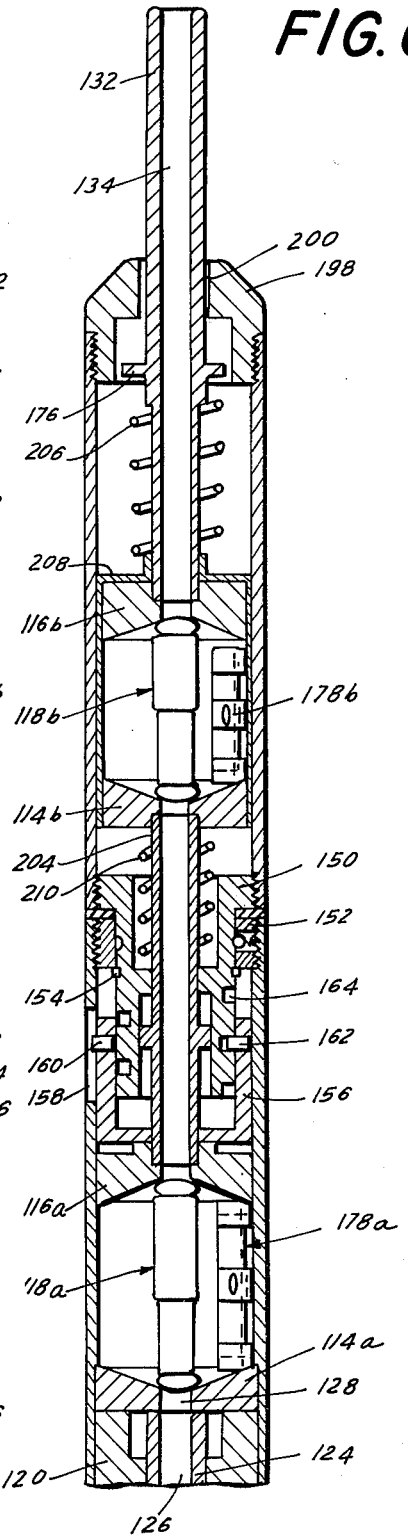

The arrangement shown in FIGS. 4 –6 operates along principles similar to those described above. In this arrangement the same reference numerals as used in FIGS. 1 –3 are employed whereever functionally identical structure is used, but preceded by a 1. In addition in the arrangement of FIGS. 4 –6 two such braking units are provided, a lower unit bearing a postscript *a* and an upper unit bearing a postscript *b*. Thus, for example, the braking element of the lower unit is assigned reference 118*a* of the upper unit 118*b*.

The arrangement of FIGS. 4 –6 has a pair of axially aligned tubular housing parts 112*a* and 112*b* separated along a plane B —B. The upper braking element 118*b* is somewhat shorter than the lower braking element 118*b* and has a substantially stiffer spring as will be described below. No compression spring is provided in the bore 174 for the lower brake. In addition the spring 166 and ball 168 are radially engageable in the adjustment member 150 which is fixed to the upper housing member 112*b*. Similarly, the annular array of notches 170 is open radially outwardly in this arrangement.

The upper housing part 112*b* is screwed onto the upper end of the adjustment sleeve 150 and a ring 196 fixed in the top of the lower housing part 112*a* allows this upper part 112*b* and the ring 150 to rotate freely relative to the lower part, a snap ring 154 being provided to prevent relative axial displacement of the two parts 112*b* and 112*a*. Thus it is possible to screw the members together from the position shown in FIG. 4 to the position shown in FIG. 6. The upper housing part 112*b* is closed by means of a screwed-on cover cap 198. The inlet tube 132 extends downwardly through an axial bore 200 formed in the cap 198 and is connected fixedly at its lower end to the upper wall member 116*b*. This member in turn is axially slidable inside a cup-shaped sleeve 202 which in turn is axially slideable in the housing 112 but which is axially rigidly connected to the lower wall member 114*b* of the upper brake. This lower member 114*b* is in turn axially connected through a rigid link tube 204 to the upper wall member 116*a* of the lower brake. A compression spring 206 bears at its lower end on the upper wall 208 of the cup 202 at its upper end on the flange 176 of the inlet tube 132. In addition a compression spring 210 bears at its upper end on the lower surface of the member 114*b* and extends into a counterbore 212 of the member 150 and bears at its lower end on an intermediate flange 214 formed in this member 150. The link tube 204 which forms part of the passage through the brake of FIGS. 4 –6 has an intermediate flange 205 which can bear on the lower edge of the flange 214 so as to define the uppermost position of the link 204.

Since the member 114*b* is pressed upwardly by the spring 210, this spring 210 also presses the member 116*a* upwardly against the lower surface of the ring 156 since the two members 114*b* and 116*a* are axially joined by the link tube 204 which is screwed, press-fitted, or glued into them. Furthermore the relative positions of the members 114*b* and 116*b* is normally constant and is not adjustable. Thus, screwing of the member 156 relative to the member 150 by rotating the upper housing part relative to the lower housing part 112*a* will displace the members 116*a*, 114*b*, and 116*b* all downwardly so as to exchange the extent of compression of the relatively stiff spring in the capsule 118*a*. Since even at minimum compression the spring in capsule 118 is stiffer than the spring in 118*b*, this adjustment of the lower brake unit alone gives more than sufficient range of the adjustment to the apparatus. It is noted that in this device there are four places where the filament is pinched between two members in the passage. Thus it is pinched first between the head 146*b* and the ring 116*b*, then between the head 144*b* and the ring 114*b*, then between the head 146*a* and the ring 116*a*, and finally between the head 144*a* and the ring 114*a*. The position of the device when adjusted for maximum tensioning is shown in FIG. 6.

In order to thread the device the inlet tube or sleeve 132 is pressed downwardly in the direction of arrow A of FIG. 4. This presses the upper ring 116*b* downwardly inside the sleeve 202 and, since the spring of the capsule 118*b* is always less stiff than the spring of the capsule 118*a*, this causes the capsule 118*b* to be compressed until the bridge element 178*b* becomes aligned between the holes 130*b* and 128*b* as shown in FIG. 5. A further depression of the inlet tube 132 will then be transmitted through this bridge 178*b* to the lower member 114*b* and will cause the member 116*a* to be depressed downwardly through the link 204. The lower bridge 178*a* will then align between the holes 130*a* and 128*a* as also shown in FIG. 5 so that a clear throughgoing passage is formed through the entire thread brake. Thus even in a relatively complicated device having two independent thread brakes it is possible simply and easily to thread the device.

Once the downward pressure is released from the inlet tube 132*a* the spring 206 will press the tube 32*a* and the upper member 116*a* upwardly until the upper surface of the member 116*b* rests on the upper wall 208 of the sleeve 202. At the same time the spring 210 will press the lower member 114*b* and the upper member 116*a* upwardly to the rest position defined by the lower surface of the adjustment member 156, again leaving the device fully operational with the magents of the bridges 178*a* and 178*b* holding them against the insides of the housing 112*a* and of the sleeve 202 as described with the reference to FIGS. 1 –3.

Figure 9:
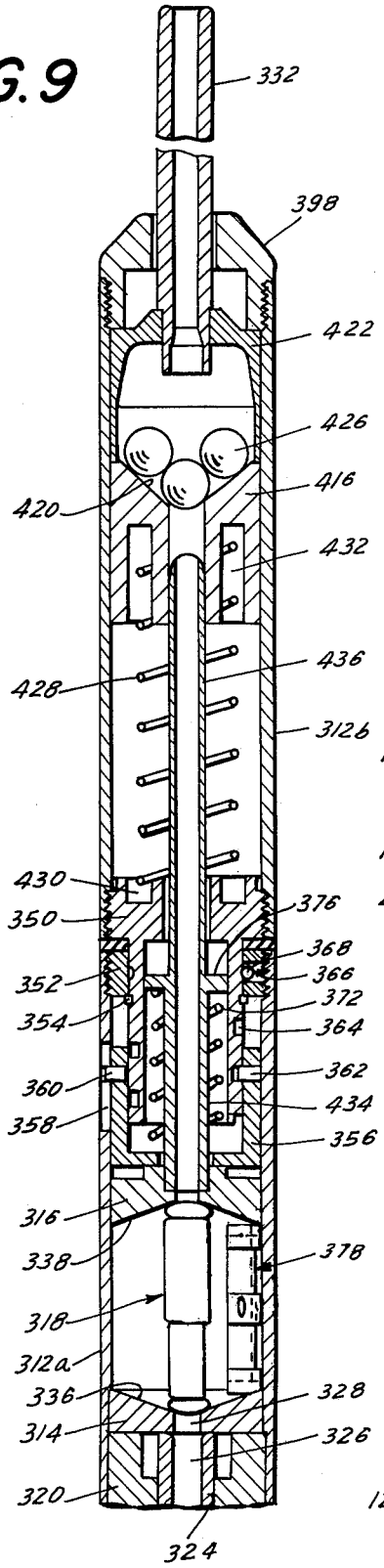
FIGS. 7, 8 and 9 are views similar to FIGS. 1, 2 and 3, respectively, showing yet another thread brake according to the present invention.
Figure 7:
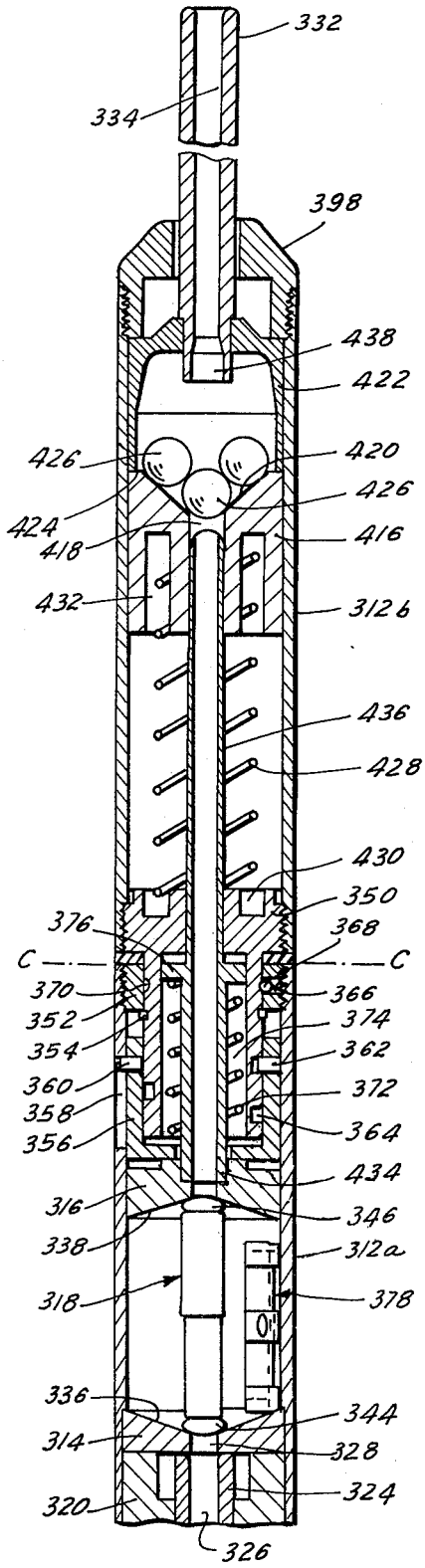
Figure 8:
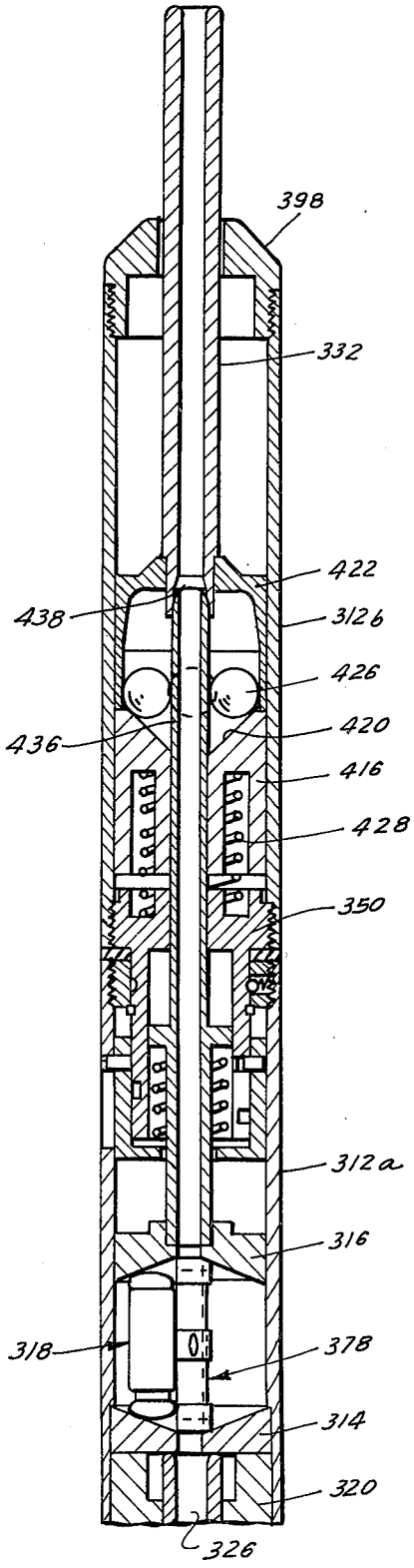

The arrangement shown in FIGS. 7 –9 again has a pair of brakes, the lowermost brake being virtually identical to the brakes described with reference to FIGS. 4 –6. The same reference numerals are used in FIGS. 7 –9 as in FIGS. 4 –6, preceded by a 3 for functionally identical structure. Thus the braking element 318 is the equivalent of the braking element 118*a* and in all other respects the arrangement is identical below plane C — C to the arrangement of FIGS. 4 –6 below the plane B —B.

In this arrangement the housing has a pair of longitudinally aligned housing parts 312*a* and 313*b*, the adjustment sleeve 350 being screwed into the upper part 312*b* so that relative rotation of these two parts relative to each other adjusts the device as described with reference to FIGS. 4 –6.

The upper housing part 312*b* is closed by a cap 398 and is provided with a vertically displaceable pressure or seat member 416 having a central passage-defining hole 418 and formed with an upwardly concave frustoconical seat or surface 420. A downwardly cupped element 422 fixed to the lower end of the inlet tube 332 bears on the edge 324 of this member 416. A plurality, here three, of steel balls 426 lie on this surface 420. One of the balls naturally blocks the passage 418 and the other balls merely bear on the blocking ball so as to add their weight to the force this ball exerts at the rim of the passage 418.

A compression spring 428 is seated at its lower end in an axially centered upwardly opened annular groove 430 formed in the member 350 screwed into the lower end of the upper housing part 312*b*. The upper end of the compression spring 428 bears in a downwardly open annular groove 432 formed in the element 416 so as normally to bias this element 416 upwardly with its edge 424 against the member 422.

In this arrangement a tube 434 functionally equivalent to the tube 204 of FIG. 4 is screwed at its lower end into the upper wall member 316 and is provided at its upper end with a tubular extension 436 having an oblique upper end that engages normally in the bore 418. This upper end 436 is snugly receivable in a widened counterbore 438 in the lower end of the tube 332 and centered on the bore 334 of this inlet tube 332.

During use the filament being twisted passes downwardly through the bore 334 and is pinched by the one ball 426 against the surface 420. Then this filament passes downwardly through the tube 436 and the tube 434 and is pinched between the upper head 346 of the braking capsule 318 and the surface 338 and then between the lower head 344 and the surface 336. Thus three braking locations are provided.

In order to thread the arrangement the tube 332 is pressed downwardly. This presses the element 416 downwardly, causing the tube 436 to rise upwardly and deflect the balls 426 to the side. Since the upper end of this tube 436 is oblique the balls 426 cannot sit on this upper end and will be arrayed around it as shown in FIG. 8. The upper end of the tube 436 will then fit into the counterbore 438. Further downward depression of the inlet tube 332, normally exerted by resting a pneumatic threader on it, will therefore press the tube 436 downwardly and, with it, the upper wall member 316 so as laterally to displace the braking capsule 318 and to move the threading element 378 into line with the bores of the various elements. In this manner the passage is opened up from top to bottom but of a regularly uniform cross-section so that filaments can easily be blown through it.

Although the arrangement according to the present invention has been described with some particularly as with reference to a double-thread twisting arrangements, it is of course possible to use this arrangement in other contexts where the braking of a filament, strand, or similar workpiece is desired. The invention is not intended to be limited to the particular use of this brake in a double-thread twister.

I claim:

1. A thread brake comprising:

a housing defining a relatively narrow thread passage and along said passage a relatively wide compartment having a wall at said passage;

a braking element in said compartment normally lying in a braking position against said wall at said passage and displaceable laterally of said passage into a position clear of said passage, whereby a thread extending along said passage is normally pinched by said braking element against said wall;

a threading element in said housing and having an elongated relatively narrow open course, said threading element being displaceable between a position with said course out of alignment with said passage in said compartment and a threading position with said course aligned with said passage in said compartment; and operating means for displacing said threading element from outside said housing into said threading position and for simultaneously displacing said braking element out of said braking position.

2. The brake defined in claim 1 wherein said threading element is in said compartment and is laterally displaceable relative to said passage into and out of said threading position, said threading element being formed with a longitudinally extending slot constituting said open course.

3. The brake defined in claim 2, further comprising means normally holding said threading element in said position with its slot out of alignment with said passage in said compartment.

4. The brake defined in claim 3 wherein said means holding said threading element includes a magnetic portion of said housing and a permanent magnet carried on said threading element.

5. The brake defined in claim 3 wherein said braking element is a spring-loaded compressible capsule having a pair of ends, said housing having a pair of such walls at said compartment each one concave toward the other wall and each engaging a respective end of said capsule, said operating means being connected to one of said walls for displacing same toward the other, said threading element being relatively longitudinally incompressible and having a pair of ends each engageable with a respective wall, whereby displacement of said one wall toward the other wall cams said braking element into a position with said course aligned with said passage and simultaneously pushes said braking element laterally clear of said passage with said braking element.

6. The brake defined in claim 5, further comprising spring means normally urging said one wall away from said other wall.

7. The brake defined in claim 6, further comprising adjustment means for defining a plurality of rest positions for said one wall relative to said other wall, whereby the distance between said walls as established by said rest position determines the extent of compression of said capsule and the braking effect of said capsule on a thread pinched thereby against said walls.

8. The brake defined in claim 7 wherein said adjustment means includes a ring threaded in said housing and normally abutting said one wall and defining said rest position therefor.

9. The brake defined in claim 8 wherein said ring is formed with a generally helical formation and said housing is provided with a projection engaging said formation, whereby relative rotation of said ring and said housing displaces said one wall longitudinally of said passage and relative to said other wall.

10. The brake defined in claim 9, further comprising spring-loaded locking means for holding said ring in any of a multiplicity of angularly offset positions relative to said housing.

11. The brake defined in claim 5 wherein said housing is provided with an inlet tube connected to said one wall and defining a portion of said passage.

12. The brake defined in claim 5 wherein said housing is formed with a second relatively wide compartment along said passage having a second wall at said passage, said brake further comprising a second threading element independent of the first-mentioned braking element and normally lying in a braking position against said second wall at said passage and displaceable laterally out of said passage into a position clear of said passage, and a second threading element having an elongated relatively narrow open course and provided in said housing, said second threading element being separate from the first-mentioned threading element and being displaceable between a position with its course out of alignment with said passage in said second compartment and threading position with its course aligned with said passage in said compartment, said operating means being connected to both of said threading elements for displacement thereof from outside said housing into said said threading positions with simultaneous displacement of the respective braking elements out of said braking positions.

13. The brake defined in claim 12 said second braking element is a second spring-loaded compressible capsule having a pair of ends, said housing a pair of such walls at said second compartment each concave toward the other wall and each engaging a respective end of said second capsule, said operating means being connected to one of said walls of said second compartment for displacing same toward the other wall of said second compartment, said threading element being relatively longitudinally incompressible and having a pair of ends each engageable with respective wall of said second compartment.

14. The brake defined in claim 13 wherein said operating means includes a link between said one wall of said first compartment and said one wall of said second compartment.

15. The brake defined in claim 14 wherein said link is a tube forming a portion of said passage and interconnecting said other wall of said first compartment and said one wall of said second compartment, whereby displacement of said one wall of said first compartment toward the respective other wall is transmitted to said one wall of said second compartment.

16. The thread brake defined in claim 15, further comprising spring means normally urging said one walls away from the respective said other walls.

17. The brake defined in claim 12 wherein said housing has an upper part containing said walls of said first compartment and a lower part containing said walls of said second compartment, said parts being rotatable relative to each other, said brake further comprising adjustment means including a ring longitudinally displaceable in said lower part but nonrotatable relative thereto and defining a rest position for said one wall of said second compartment relative to the respective said other wall and interengaging thread formations of said upper part and said ring for axially displacing said ring relative to said lower part.

18. The brake defined in claim 1 wherein said threading element is a tube forming part of said passage and displaceable longitudinally of said passage into and out of said compartment.

19. The brake defined in claim 18 wherein said wall is upwardly concave and said braking element is at least one ball resting on said wall and normally overlying said passage.

20. The brake defined in claim 19 wherein said wall is displaceable down around said tube, whereby upward displacement of said tube through said wall displaces said ball laterally clear of said passage.

21. The brake defined in claim 20 wherein said operating means includes a spring normally urging said wall upwardly and an inlet tube longitudinally connected to said wall and forming a portion of said passage.

22. The brake defined in claim 19 wherein said housing is formed with a second relatively wide compartment along said passage having a second wall at said passage, said brake further comprising a second threading element independent of the first-mentioned braking element and normally lying in a braking position against said second wall at said passage and displaceable laterally out of said passage into a position clear of said passage, and a second threading element having an elongate relatively narrow open course and provided in said housing, said second threading element being separate from the first-mentioned threading element and being displaceable between a position with its course out of alignment with said passage in said second compartment and a threading position with its course aligned with said passage in said second compartment, said operating means including a link operatively connecting both of said threading elements for displacement thereof from outside said housing into said threading positions with simultaneous displacement of the respective braking elements out of said braking positions.

* * * * *